US008162425B2

(12) United States Patent
Kato et al.

(10) Patent No.: US 8,162,425 B2
(45) Date of Patent: Apr. 24, 2012

(54) IMAGE RECORDING APPARATUS

(75) Inventors: Shigeki Kato, Toyoake (JP); Katsuaki Suzuki, Gifu (JP); Masahiro Nishizaki, Iwakura (JP); Koji Nakayama, Seki (JP)

(73) Assignee: Brother Kogyo Kabushiki Kaisha, Nagoya-shi, Aichi-ken ( * ) Notice: Subject to any disclaimer, the term of this patent is extended or adjusted under 35 U.S.C. 154(b) by 1062 days.

(21) Appl. No.: 12/057,701

(22) Filed: Mar. 28, 2008

(65) Prior Publication Data

US 2008/0238959 A1 Oct. 2, 2008

(30) Foreign Application Priority Data

Mar. 30, 2007 (JP) ..... 2007-091740

(51) Int. Cl.
*B41J 25/308* (2006.01)

(52) U.S. Cl. ..... 347/8; 347/4; 347/5; 347/9; 347/16; 347/101; 347/104; 347/105; 347/106

(58) Field of Classification Search ..... 347/4–5, 347/8–9, 16, 101, 104–106
See application file for complete search history.

(56) References Cited

U.S. PATENT DOCUMENTS 4,739,415 A * 4/1988 Toyono et al. ..... 358/296
5,541,626 A * 7/1996 Hiramatsu et al. ..... 347/8
5,847,719 A * 12/1998 Yamaguchi et al. ..... 346/134
6,471,315 B1 * 10/2002 Kurata ..... 347/8
6,666,536 B2 * 12/2003 Nakanishi et al. ..... 347/8
2003/0063174 A1 * 4/2003 Kanome ..... 347/104
2004/0017457 A1 * 1/2004 Anami et al. ..... 347/104
2005/0152726 A1 * 7/2005 Ueda et al. ..... 400/56
2005/0225622 A1 * 10/2005 Anami et al. ..... 347/104
2005/0270355 A1 * 12/2005 Sootome et al. ..... 347/104
2006/0082604 A1 * 4/2006 Florence et al. ..... 347/5
2007/0047157 A1 * 3/2007 Miyahara et al. ..... 360/324.11
2007/0070097 A1 * 3/2007 Bich et al. ..... 347/8
2008/0012920 A1 * 1/2008 Matsuda ..... 347/104

FOREIGN PATENT DOCUMENTS

JP 05-301413 11/1993

(Continued)

OTHER PUBLICATIONS

Notice of Reasons for Rejection (Office Action) dated Feb. 10, 2009 for corresponding Japanese Application No. 2007-091740—with a partial English translation.

*Primary Examiner* — Ryan Lepisto
*Assistant Examiner* — Guy Anderson
(74) *Attorney, Agent, or Firm* — Banner & Witcoff, Ltd

(57) ABSTRACT

An image recording apparatus improves the operating efficiency while preventing trouble due to the contact of a recording medium with a discharging surface of a recording head. A distance sensor for detecting the distance of the leading edge of a sheet from a conveying surface is provided upstream from the inkjet head in the conveying direction of the sheet. A gap control unit controls a frame moving mechanism to move the inkjet head up so that a gap between the discharging surface and the conveying surface increases when the distance detected by the distance sensor is above a first distance, and the gap distance may be increased by different amounts depending on the distance detected by the distance sensor. A discharging control unit controls the inkjet head to discharge ink droplets after the gap is increased.

19 Claims, 12 Drawing Sheets

FOREIGN PATENT DOCUMENTS

| | | | |
|---|---|---|---|
| JP | 09-193368 | | 7/1997 |
| JP | 2002-192799 | A | 7/2002 |
| JP | 2002-205432 | A | 7/2002 |
| JP | 2004-299155 | | 10/2004 |
| JP | 2006-021435 | | 1/2006 |
| JP | 2006-314174 | A | 11/2006 |
| JP | 2007-076109 | | 3/2007 |
| JP | 2007-098648 | | 4/2007 |

* cited by examiner

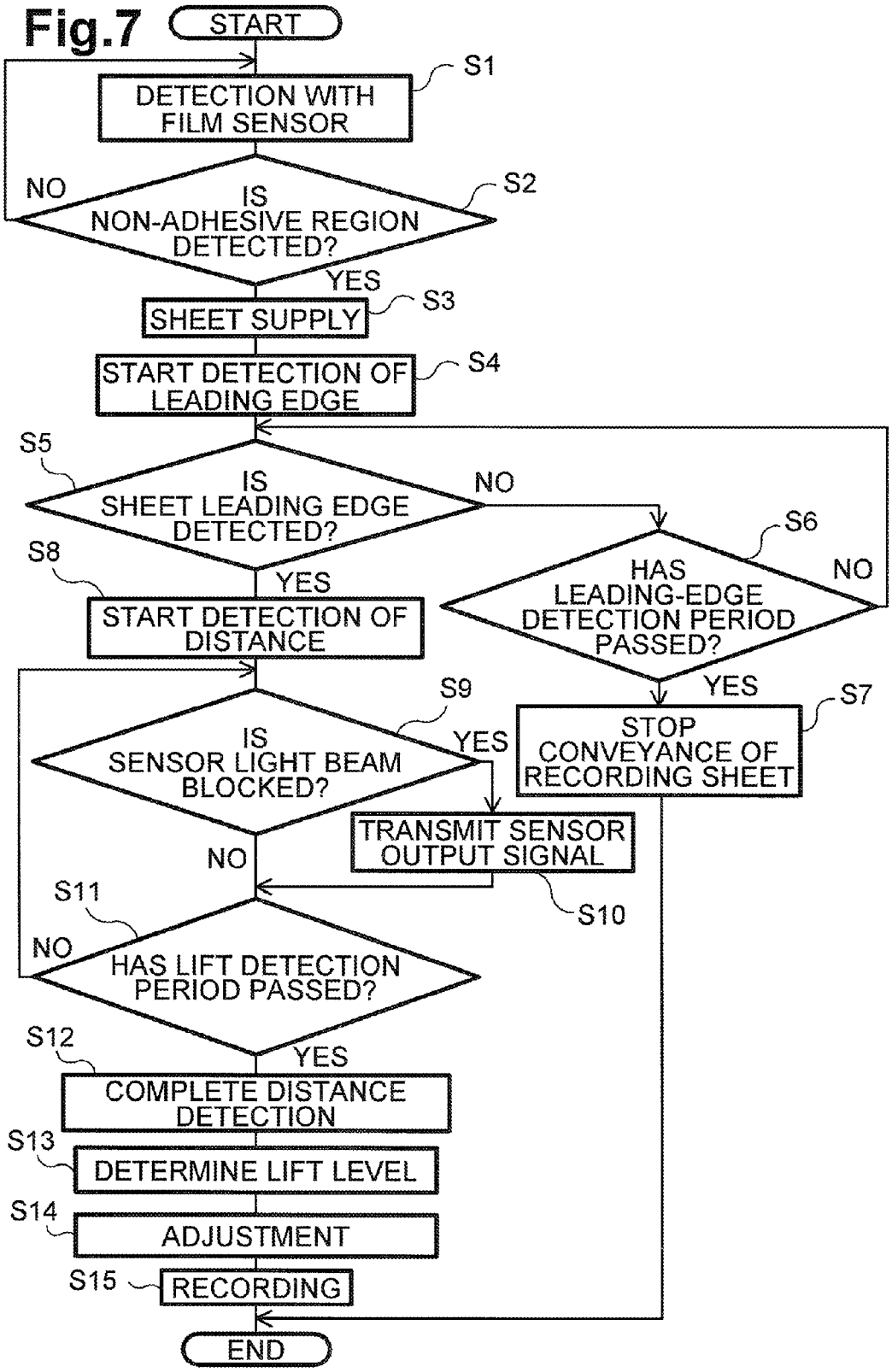
Fig.7
START
S1
DETECTION WITH FILM SENSOR
S2
IS NON-ADHESIVE REGION DETECTED?
NO
YES
S3
SHEET SUPPLY
S4
START DETECTION OF LEADING EDGE
S5
IS SHEET LEADING EDGE DETECTED?
NO
S6
HAS LEADING-EDGE DETECTION PERIOD PASSED?
NO
YES
S7
STOP CONVEYANCE OF RECORDING SHEET
S8
YES
START DETECTION OF DISTANCE
S9
IS SENSOR LIGHT BEAM BLOCKED?
YES
TRANSMIT SENSOR OUTPUT SIGNAL
S10
NO
S11
HAS LIFT DETECTION PERIOD PASSED?
NO
YES
S12
COMPLETE DISTANCE DETECTION
S13
DETERMINE LIFT LEVEL
S14
ADJUSTMENT
S15
RECORDING
END

IMAGE RECORDING APPARATUS

BACKGROUND

1. Field of the Disclosure

The present disclosure relates to an image recording apparatus that records an image on a recording medium by discharging droplets from a recording head.

2. Description of the Related Art

A conventional image recoding apparatus discloses an inkjet recording apparatus including line-type recording heads each having an ink discharging surface with nozzles for discharging ink, and a conveyor belt laid between two rollers (hereinafter referred to as a line-type recording apparatus). In this recording apparatus, a recording sheet is conveyed while being drawn onto a conveying surface of the conveyor belt facing the ink discharging surface, and an image is recorded on the recording sheet by selectively discharging ink from the recording heads onto the recording sheet. Herein, a line-type recording head has a length corresponding to the width of a recording sheet in a direction orthogonal to the conveying direction of the recording sheet, and can record an image on a surface of the recording sheet conveyed by a conveying means, such as a conveyor belt, while staying at rest. An inkjet recording apparatus is also known which includes a so-called serial scan recording head that reciprocates in the direction orthogonal to the conveying direction of a recording sheet (hereinafter referred to as a serial-type recording apparatus). This serial-type recording apparatus records an image on the recording sheet by alternately repeating the conveyance of the recording sheet and the forward or backward movement of the recording head. Since the line-type recording head itself does not move during recording, as described above, it can perform image recording at a speed higher than that of the serial-type recording apparatus.

In the line-type recording apparatus disclosed in the above publication, a recording sheet on the conveying surface sometimes lifts from the conveyor belt, for example, when the recording sheet is curled. Particularly when the recording sheet is relatively thick and sturdy, it easily lifts from the conveyor belt. Depending on the degree of this lifting, the recording sheet sometimes rubs against the ink discharging surface. Consequently, the recording sheet is soiled with unnecessary ink, and this may lead to waste of recording sheets and damage to the ink discharging surface of the recording head. Moreover, the recording sheet sometimes jams, and this brings about frequent maintenance operations by the user.

Accordingly, in the line-type recording apparatus disclosed in the above publication, a detection mechanism for detecting lifting of the recording sheet from the conveyor belt is provided upstream from the recording heads in the conveying direction of the recording sheet. When lifting of the recording sheet is detected by the detection mechanism, the recording apparatus executes control to stop the conveyance of the recording sheet in order to avoid the above-described problems due to the contact of the recording sheet with the ink discharging surface.

However, when recording is stopped by stopping the conveyance of the recording sheet every time lifting of the recording sheet is detected, as described above, the operating efficiency of the line-type recording apparatus decreases. In particular, if the recording operation is frequently interrupted, the line-type recording apparatus loses the advantage in its capability to perform image recording at a speed higher than that of the serial-type recording apparatus.

SUMMARY

Accordingly, one or more aspects of the present disclosure relates to improving the operating efficiency while preventing problems due to the contact of a recording sheet with a discharging surface of a recording head.

BRIEF DESCRIPTION OF THE DRAWINGS

FIG. 7 is a flowchart showing a processing procedure performed by the printer shown in FIG. 1.

DETAILED DESCRIPTION

Figure 1:
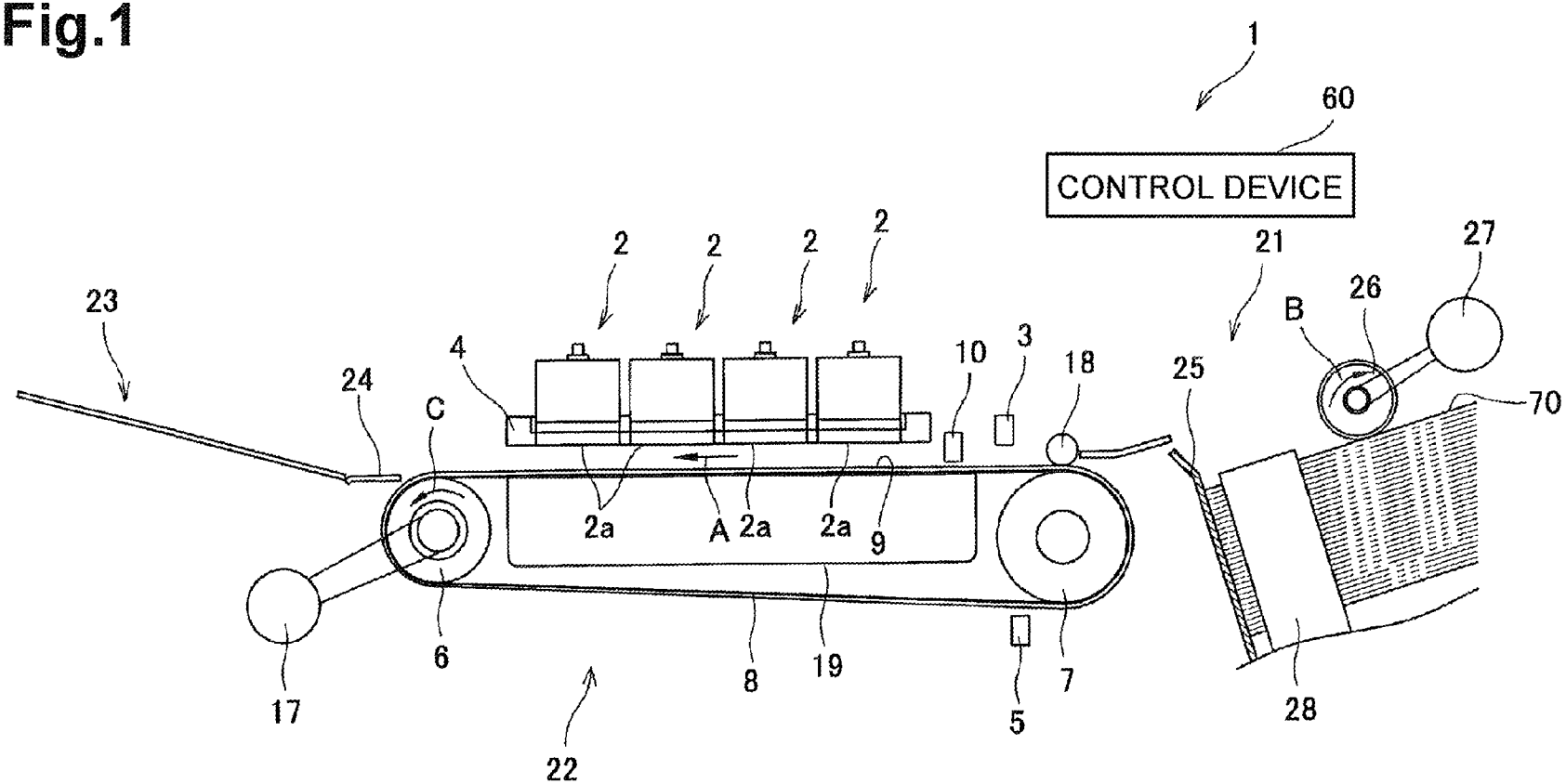
FIG. 1 is a schematic sectional side view of a printer according to a first embodiment described herein.

Illustrative embodiments of the present disclosure will be described below with reference to the drawings.

It is noted that various connections are set forth between elements in the following description. It is noted that these connections in general and, unless specified otherwise, may be direct or indirect and that this specification is not intended to be limiting in this respect.

General Overview of One or More Aspects of the Invention

A first example may include an image recording apparatus with a recording head having one or more ink droplet discharge ports; a conveyor configured to convey a recording medium opposite the recording head; and a controller configured to adjust a distance between the conveyor and the recording head based on a measurement of an elevation of the recording medium between the recording head and the conveyor.

In another aspect, an image recording apparatus may include a recording head having a discharging surface on which discharging ports for discharging droplets are provided; first and second rollers having rotation shafts parallel to each other; an endless conveyor belt laid between the first and second rollers and configured to convey a recording medium in a conveying direction from the first roller to the second roller while supporting the recording medium on a conveying surface serving as an outer peripheral surface facing the discharging surface; a shift mechanism configured to shift the recording head or the first and second rollers in a direction orthogonal to the discharging surface so as to change a gap between the discharging surface and the conveying surface; a distance sensor configured to detect a distance of a leading edge of the recording medium from the conveying surface when the leading edge of the recording medium is placed at a first predetermined position on the conveying surface upstream from the recording head in the conveying direction; a gap control unit configured to control the shift mechanism so that the gap becomes larger when the distance detected by the distance sensor is above a first distance, and the gap distance may be increased by different amounts depending on the distance detected by the distance sensor; and a discharging control unit configured to control the recording head to discharge the droplets from the discharging ports after the gap is increased by the shift mechanism under the control of the gap control unit.

With this configuration, when the distance between the leading edge of the recording medium and the conveying surface is more than or equal to the first distance and within the second predetermined range, image recording can be performed after the gap between the discharging surface and the conveying surface is increased. Therefore, the recording medium is prevented from touching the discharging surface. This can improve the operating efficiency while avoiding waste of the recording medium, damage to the ink discharging surface, and jamming of the recording media.

Optionally, the discharging control unit controls the recording head so that the minimum volume of droplets discharged from the recording head when the distance detected by the distance sensor is within the second predetermined range is more than when the distance is within the first predetermined range.

In general, when droplets are discharged from the discharging ports, mist is produced as minute droplets float without landing on a recording medium. After the mist floats in the apparatus, it adheres to the devices in the apparatus and the recording medium. Therefore, various improper operations are caused, and the soiled recording medium is wasted. Further, the amount of mist increases as the volume of droplets discharged from the discharging ports decreases and as the gap between the discharging surface and the conveying surface increases. The above-described configuration of the present disclosure can reduce mist of droplets even when the gap is increased. Therefore, improper operations and soiling of the recording medium due to the droplet mist can be avoided.

The gap control unit may control the shift mechanism so that the gap becomes larger when the distance detected by the distance sensor is within a third predetermined range of more than or equal to the second distance and less than a third distance than when the distance is within the second predetermined range. In this case, even when the recording medium lifts high from the conveying surface, the operating efficiency can be improved while still preventing the recording medium from touching the discharging surface.

The image recording apparatus may further include a conveying-speed control unit configured to decrease a conveying speed of the recording medium conveyed by the conveying belt by decreasing a rotation speed of the first and second rollers when the distance detected by the distance sensor is within the third predetermined range.

The velocity of droplets discharged from the discharging ports varies slightly. Because of the variations in velocity of droplets, the landing positions of droplets on the recording medium are displaced in the conveying direction of the recording medium. The amount of displacement increases as the conveying speed of the recording medium increases and as the gap between the discharging surface and the conveying surface increases. With the above-described configuration of the present disclosure, it is possible to prevent the amount of displacement of the landing position from increasing even when the gap is increased. Therefore, degradation of the quality of recorded images can be prevented.

The image recording apparatus may further include a recording stop unit configured to stop the control of the recording head by the discharging control unit so that the droplets do not land on the recording medium when the distance detected by the distance sensor is within a fourth predetermined range of more than or equal to a fourth distance that is more than or equal to the third distance. In this case, jamming of the recording medium can be prevented even when the recording medium lifts from the conveying surface to an extent that cannot be rectified by changing the gap between the discharging surface and the conveying surface.

The image recording apparatus may further include a leading-edge sensor configured to detect whether the leading edge of the recording medium reaches a second predetermined position on the conveying surface upstream from the first predetermined position in the conveying direction. The distance sensor may detect the distance of the leading edge of the recording medium from the conveying surface during a predetermined time after the leading edge of the recording medium is detected by the leading-edge sensor. This prevents detection error of the distance.

First Embodiment

Figure 2:
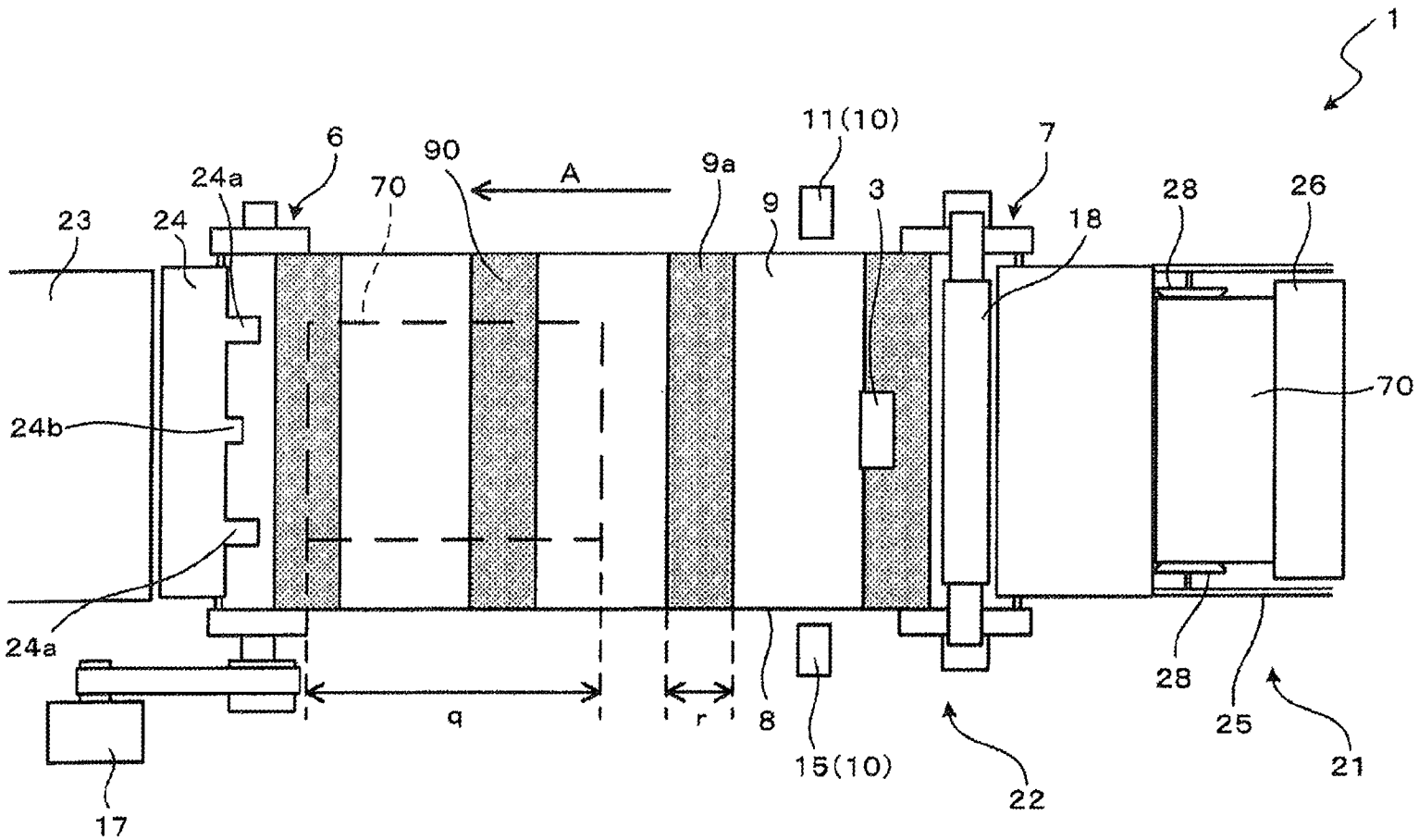
FIG. 2 is a plan view of the printer shown in FIG. 1 except for inkjet heads.
Figure 3:
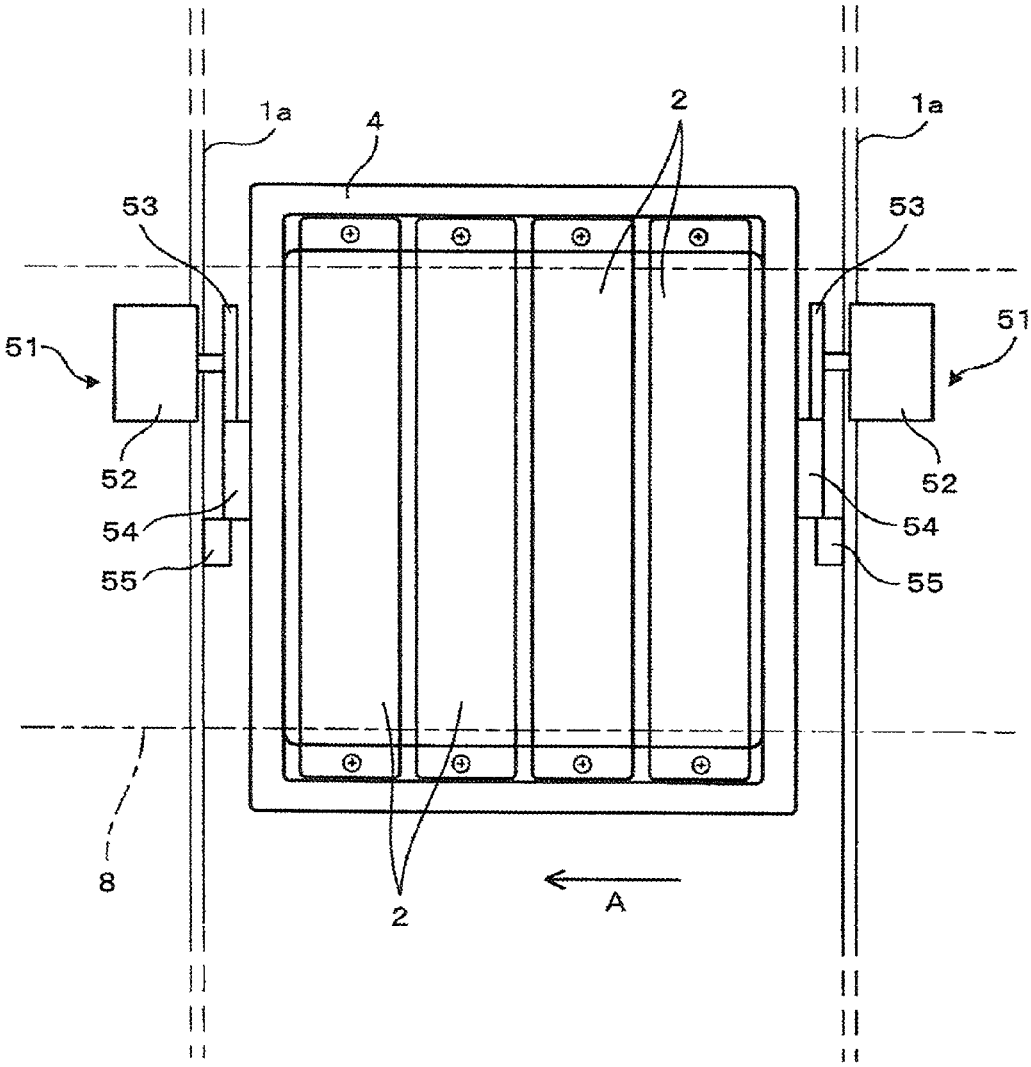
FIG. 3 is a plan view of the inkjet heads and their surroundings shown in FIG. 1.

FIG. 1 is a schematic sectional side view of a printer according to a first embodiment of the present disclosure. FIG. 2 is a plan view of the printer shown in FIG. 1, except for inkjet heads. FIG. 3 is a plan view of four inkjet heads and their surroundings shown in FIG. 1. As shown in FIG. 1, a printer 1 includes four inkjet heads 2 corresponding to four color inks (magenta, yellow, cyan, and black). Each of the inkjet heads 2 has a discharging surface 2*a* on which a plurality of nozzles (not shown) for discharging ink droplets are provided. That is, the printer 1 is a color inkjet printer. The printer 1 also includes a feeding mechanism 21 that feeds sheets 70 stored in a sheet tray 25, and a conveying mechanism 22 that conveys a sheet 70 fed by the feeding mechanism 21 while the sheet 70 faces the discharging surfaces 2*a* of the inkjet heads 2. The operation of the printer 1 is controlled by a control device 60.

The four inkjet heads 2 are disposed above the conveying mechanism 22, and are fixed to a frame 4 such as to be adjacent to one another in the conveying direction (direction of arrow A) of the sheets 70, as shown in FIGS. 1 and 3. The length of the inkjet heads 2 corresponds to the width of sheets of the largest possible size that are used in the printer 1 in the direction orthogonal to the conveying direction. That is, as shown in FIG. 3, each inkjet head 2 has a rectangular shape in plan view such as to extend in the main scanning direction (up-down direction in FIG. 3) orthogonal to the conveying direction of the sheets 70. Thus, the four inkjet heads 2 are line heads, and the printer 1 is a line-type printer (line-type recording apparatus).

The frame 4 is supported so as to be movable in the vertical direction (a direction perpendicular to the paper plane of FIG. 2) by frame moving mechanisms 51 shown in FIG. 3. The frame moving mechanisms 51 may be provided on either side of the frame 4 in the conveying direction (direction of arrow A) of the sheets 70. Each of the frame moving mechanisms 51 may include a driving motor 52 serving as a driving source for vertical movement, a pinion gear 53 fixed to a shaft of the driving motor 52, a rack gear 54 meshed with the pinion gear 53, and a guide 55 provided so that the rack gear 54 is placed between the guide 55 and the pinion gear 53. The driving motor 52 is fixed to a main frame 1*a* of the printer 1, the rack gear 54 stands on the frame 4, and the guide 55 is fixed to the main frame 1*a*.

In this configuration, when the pinion gears 53 are rotated forward and in reverse by the two driving motors 52 that are synchronized, the rack gears 54 move in the vertical direction. With this vertical movement of the rack gears 54, the frame 4 and the four inkjet heads 2 move in the vertical direction.

The feeding mechanism 21 may include a pickup roller 26 that feeds out the uppermost one of a plurality of sheets 70 stored in the sheet tray 25. The pickup roller 26 is rotated clockwise (direction of arrow B) in FIG. 1 by a driving motor 27, and the sheet 70 is fed from right to left in FIG. 1. The feeding mechanism 21 may also include a pair of positioning plates 28 for adjusting the positions in the main scanning direction of the sheets 70 stacked in the sheet tray 25. The positioning plates 28 are provided in the sheet tray 25, and are in contact with either side of the sheets 70 in the conveying direction (direction of arrow A), as shown in FIG. 2. In the first embodiment, the sheets 70 are positioned by the positioning plates 28 so that the centers of the sheets 70 in the main scanning direction coincide with the center of a below-described conveyor belt 8 in the main scanning direction.

The conveying mechanism 22 may include two belt rollers 6 and 7 having rotation shafts parallel to each other, and an endless conveyor belt 8 laid between the belt rollers 6 and 7, as shown in FIG. 2. The belt roller 6 is provided on the downstream side of the sheets 70 in the conveying direction (on the left side in FIGS. 1 and 2). The belt roller 6 is rotated counterclockwise (in the direction of arrow C) in FIG. 1 by a driving motor 17. As shown in FIG. 1, the diameter of the belt roller 6 is smaller than that of the belt roller 7. In an area enclosed by the conveyor belt 8, a platen 19 substantially shaped like a rectangular parallelepiped may be provided so as to support the conveyor belt 8 from the inner peripheral side.

The conveyor belt 8 may be formed by siliconizing a surface of a base material formed of a rubber material, such as ethylene propylene rubber (EPDM). The siliconized surface has adhesiveness, and serves as an outer peripheral surface, that is, a conveying surface 9. As shown in FIG. 2, a plurality of films 9*a* that are not adhesive are bonded to the conveying surface 9. The films 9*a* extend between both ends of the conveyor belt 8 in the width direction (a direction orthogonal to the conveying direction of the sheets 70), and may be bonded at regular intervals in the conveying direction of the sheets 70. Accordingly, the conveying surface 9 includes non-adhesive regions on which the films 9*a* may be bonded and which do not draw the sheet 70, and adhesive regions on which the films 9*a* are not bonded and which draw the sheet 70 by an adhesive force. The non-adhesive regions and the adhesive regions may be alternately arranged in the conveying direction of the sheets 70. The non-adhesive regions may have some adhesiveness that is smaller than that of the adhesive regions. In the first embodiment, the films 9*a* are silver films having a light reflective characteristic.

The width r of the films 9*a* (length in the conveying direction of the sheets 70; see e.g., FIG. 2) may be half or less of the length, in the conveying direction, q, of the smallest possible sized sheet that is used in the printer 1. This allows even a small sheet to be reliably conveyed while being drawn by the adhesive regions.

A pressing roller 18 may be provided on just the downstream side of the feeding mechanism 21 such as to oppose the conveyor belt 8. The pressing roller 18 presses the sheet 70 fed from the feeding mechanism 21 against the conveying surface 9 of the conveyor belt 8. Therefore, the sheet 70 supplied by the pickup roller 26 is conveyed downstream in the conveying direction while being pressed against the conveying surface 9 by the pressing roller 18 and held by the adhesive force of the adhesive regions on the conveying surface 9.

A leading-edge sensor 3 of a reflective optical type may be provided between the pressing roller 18 and the inkjet heads 2, that is, on the upstream side of the inkjet heads 2. The leading-edge sensor 3 emits light toward a detecting position on the conveying surface 9, and detects the amount of reflected light. Therefore, whether the leading edge of the sheet 70 conveyed on the conveying surface 9 reaches the detecting position of the leading-edge sensor 3 can be determined on the basis of a detection signal output from the leading-edge sensor 3.

In addition, a distance sensor 10 may be provided between the leading-edge sensor 3 and the inkjet heads 2. The distance sensor 10 detects the distance between the leading edge of the sheet 70 and the conveying surface 9. The structure of the distance sensor 10 will now be described with reference to FIG. 4. The distance sensor 10 may be a transmissive optical sensor, and may include a light-emitting unit 11 and a light-receiving unit 15, as shown in FIG. 2. The light-emitting unit 11 and the light-receiving unit 15 may be arranged so that the conveying path of the sheet 70 is provided therebetween in the main scanning direction (vertical direction in FIG. 2) orthogonal to the conveying direction (direction of arrow A). Since it is desirable that emitted light is not diffused between the light-emitting unit 11 and the light-receiving unit 15, optionally, the distance sensor 10 uses laser light. However, the light from the distance sensor 10 is not limited to laser light, and the distance sensor 10 may be formed of any sensor that can detect the distance of the leading edge of the sheet 70 from the conveying surface 9.

Figure 4:
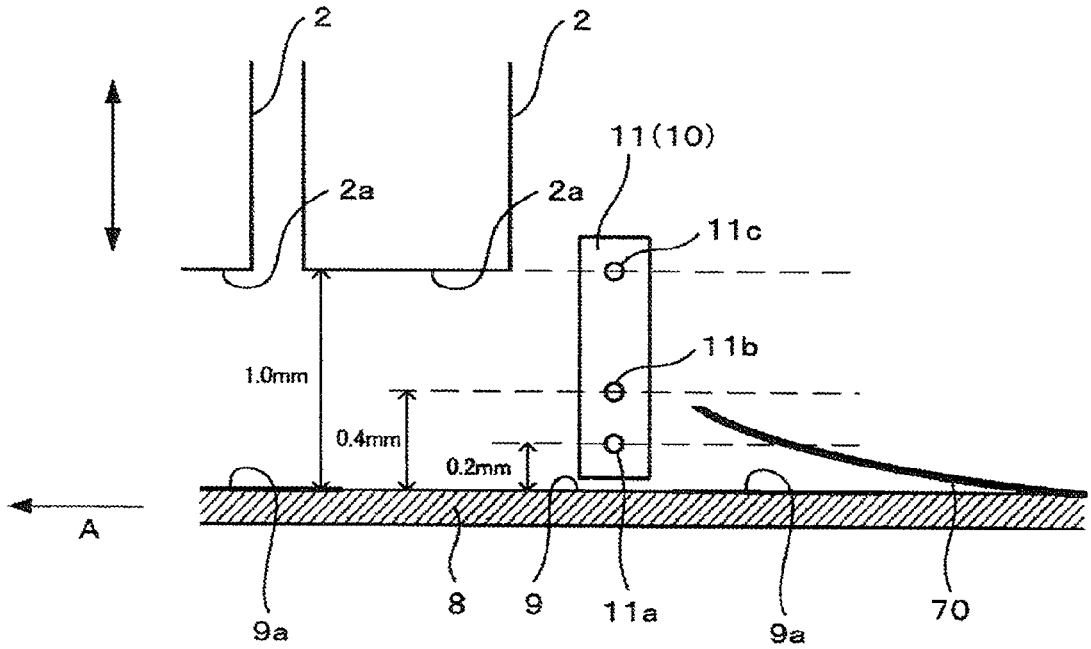
FIG. 4 is an explanatory view showing a structure of a distance sensor shown in FIG. 1.

As shown in FIG. 4, the light-emitting unit 11 may include three light-emitting elements 11*a*, 11*b*, and 11*c* arranged in that order from the side of the conveying surface 9 in the direction orthogonal to the conveying surface 9. More specifically, the light-emitting elements 11*a*, 11*b*, and 11*c* may be disposed at heights of 0.2 mm, 0.4 mm, and 1.0 mm, respectively, from the conveying surface 9. The light emitting elements 11*a*, 11*b*, and 11*c* emit light beams in the main scanning direction. That is, the level (position level from the conveying surface 9) of a light beam emitted from the light-emitting element 11*a* is lowest, the level of a light beam emitted from the light-emitting element 11*b* is intermediate, and the level of a light beam emitted from the light-emitting element 11*c* is highest. In the following description, the distance from the conveying surface 9 to the height level of the light beam from the light-emitting element 11*a* will be referred to as a "first distance", the distance to the height level of the light beam from the light-emitting element 11*b* will be referred to as a "second distance", and the distance to the height level of the light beam from the light-emitting element 11*c* will be referred to as a "third distance". The light-receiving unit 15 includes three light-receiving elements (not shown) that respectively receive the light beams emitted from the light-emitting elements 11*a*, 11*b*, and 11*c*.

In the distance sensor 10 having the above-described structure, when light beams emitted from all the light-emitting elements 11*a*, 11*b*, and 11*c* are received by the light-receiving elements without being blocked, it can be detected that the distance of the leading edge of the sheet 70 from the conveying surface 9 is within a range of more than or equal to zero, and less than the first distance (hereinafter referred to as a "first predetermined range"). When only the light beam from the light-emitting element 11 a is blocked, it can be detected that the distance of the sheet 70 is within a range of more than or equal to the first distance and less than the second distance (hereinafter referred to as a "second predetermined range"). Further, when at least the light beam from the light-emitting element 11*b* is blocked and the light beam from the light-emitting element 11*c* is not blocked, it can be detected that the distance of the sheet 70 is within a range of more than or equal to the second distance and less than the third distance (hereinafter referred to as a "third predetermined range"). In addition, when at least the light beam from the light-emitting element 11*c* is blocked, it can be detected that the distance of the sheet 70 is within a range of more than or equal to the third distance (hereinafter referred to as a "fourth predetermined range"). That is, the distance of the sheet 70 from the conveying surface 9 can be detected in four levels on the basis of the output signal from the distance sensor 10.

Referring again to FIG. 1, a sheet output tray 23 is provided downstream from the conveying mechanism 22 in the conveying direction (direction of arrow A) of the sheet 70. A separation plate 24 may be provided between the conveyor belt 8 and the sheet output tray 23. The separation plate 24 separates a sheet 70 from the conveying surface 9, and guides the sheet 70 toward the sheet output tray 23. As shown in FIG. 2, the separation plate 24 has separation claws 24*a* and 24*b* protruding from the side of the sheet output tray 23 toward the conveyor belt 8 (from left to right in the figure). The leading ends of the separation claws 24*a* and 24*b* are disposed close to the conveying surface 9 with a small gap therebetween. The separation claw 24*b* is disposed at the center of the conveyor belt 8 in the rotation axis direction of the belt roller 6. The separation claws 24*a* are arranged such that the separation claw 24*b* is disposed therebetween.

Figure 5A:
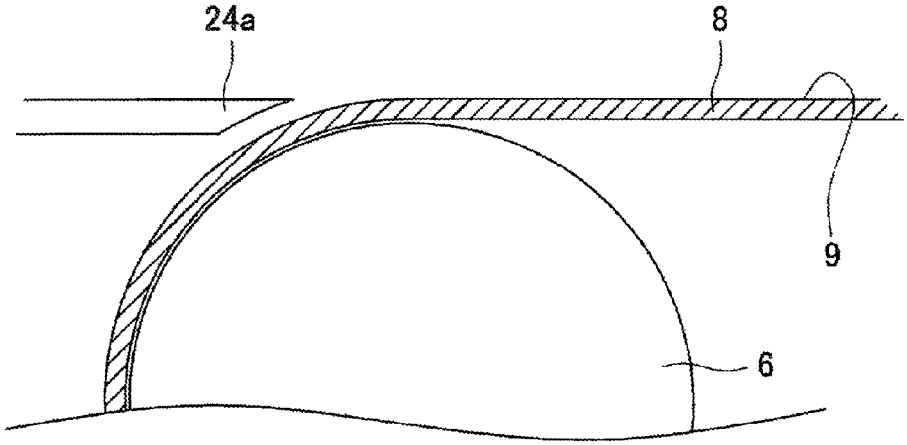
FIGS. 5(*a*) and 5(*b*) are enlarged views of separation claws in a separation plate shown in FIG. 1.
Figure 5B:
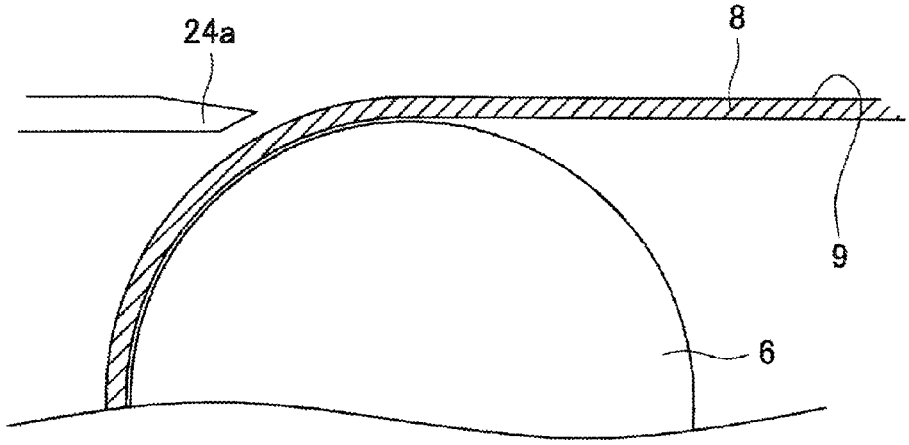

FIGS. 5(*a*) and 5(*b*) are side views, respectively, of the separation claws 24*a* and 24*b*. As shown in FIG. 5(*a*), the height of an upper surface of the separation claw 24*a* is substantially equal to the height of a portion of the conveying surface 9 of the conveyor belt 8 in contact with an upper end of the belt roller 6 (hereinafter referred to as a "conveyance height"). As shown in FIG. 5(*b*), the height of an upper surface of the separation claw 24*b* is substantially equal to the conveyance height, similarly to the separation claw 24*a*. However, since the leading end of the separation claw 24*b* is tapered, it is lower than the conveyance height. Therefore, when a sheet 70 is conveyed near the belt roller 6 while being held on the conveying surface 9 in a state in which the center of the sheet 70 in the main scanning direction is aligned with the center of the conveyor belt 8, as described above, portions near both leading sides of the sheet 70 in the conveying direction first come into contact with the two separation claws 24*a* at the conveyance height, and are thereby separated from the conveying surface 9. Subsequently, a portion near the leading center edge of the sheet 70 comes into contact with the separation claw 24*b* below the conveyance height, and is thereby separated from the conveying surface 9.

Of the belt rollers 6 and 7, the belt roller 6 disposed on the downstream side in the conveying direction has a diameter smaller than that of the belt roller 7, as described above. That is, the radius of curvature of the peripheral surface of the belt roller 6 is relatively large, and the conveyor belt 8 is curved greatly when wound around the belt roller 6. Therefore, the sheet 70 can be easily separated from the conveying surface 9 by the separation plate 24 disposed close to the belt roller 6.

Referring again to FIG. 1, a reflection type film sensor 5 is provided below the conveyor belt 8 so as to detect the films 9*a* bonded to the conveying surface 9 of the conveyor belt 8. The film sensor 5 emits light onto a detecting position on the conveying surface 9, and detects the amount of reflected light. Since the films 9*a* are silver, as described above, the non-adhesive regions with the films 9*a* and the adhesive regions without the films 9*a* are different in light reflectance. When a non-adhesive region reaches the detecting position, the amount of reflected light increases. Accordingly, whether the non-adhesive region on the conveying surface 9 reaches the detecting position of the film sensor 5 can be determined on the basis of a detection signal output from the film sensor 5.

The control device 60 will now be described. The control device 60 may include a CPU, a ROM, a RAM, and hardware such as a hard disk. The hard disk stores various software programs including a program for controlling the overall operation of the printer 1. The hardware and the software are combined so as to construct the following units 61 to 68 (see FIG. 6).

Figure 6:
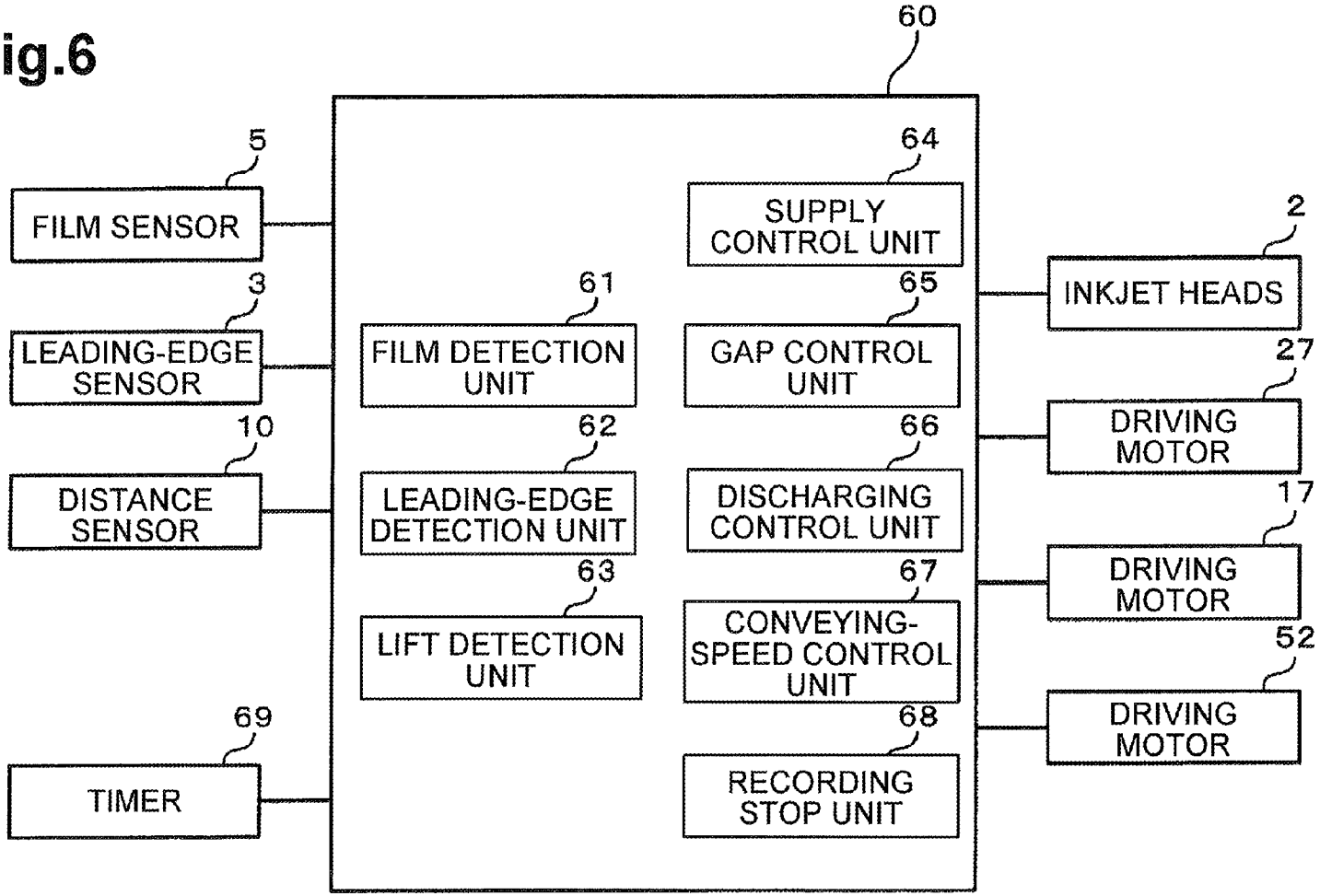
FIG. 6 is a block diagram schematically showing a configuration of a control device shown in FIG. 1.

FIG. 6 is a block diagram schematically showing the configuration of the control device 60. As shown in FIG. 6, the control device 60 may include a film detection unit 61, a leading-edge detection unit 62, a lift detection unit 63, a supply control unit 64, a gap control unit 65, a discharging control unit 66, a conveying-speed control unit 67, and a recording stop unit 68. The control device 60 is connected to the inkjet heads 2, the driving motor 27 for rotating the pickup roller 26, the driving motor 17 for rotating the belt roller 6, the driving motor 52 in the frame moving mechanism 51, the film sensor 5, the leading-edge sensor 3, and the distance sensor 10. The control device 60 is also connected to a timer 69 for outputting clock signals.

The film detection unit 61 detects, on the basis of an output signal from the film sensor 5, whether a non-adhesive region of the conveying surface 9 with the film 9*a* has reached the detecting position of the film sensor 5.

The leading-edge detection unit 62 detects, on the basis of an output signal from the leading-edge sensor 3, whether the leading edge of a sheet 70 held and conveyed by the conveying surface 9 has reached the detecting position of the leading-edge sensor 3. More specifically, the leading-edge detection unit 62 receives an output signal from the leading-edge sensor 3 and detects the leading edge of the sheet 70 during a leading-edge detection period of a predetermined time measured by the timer 69.

The lift detection unit 63 detects the distance of the sheet 70 from the conveying surface 9 in four levels (first to fourth predetermined ranges) on the basis of an output signal from the distance sensor 10. More specifically, the lift detection unit 63 receives an output signal from the distance sensor 10 and detects the distance of the sheet 70 during a lift detection period of a predetermined time measured by the timer 69. The lift detection period starts at the time when the leading edge of the sheet 70 is detected by the leading-edge detection unit 62.

The supply control unit 64 controls the timing at which a sheet 70 is supplied from the sheet tray 25 by controlling the driving of the driving motor 27 that rotates the pickup roller 26. More specifically, the supply control unit 64 supplies the sheet 70 at a predetermined timing after the non-adhesive region of the conveying surface 9 with the film 9*a* is detected by the film detection unit 61 so that the leading edge of the sheet 70 in the conveying direction (direction of arrow A) is placed in the non-adhesive region, as shown by a broken line in FIG. 2. Since the leading edge of the sheet 70 is not drawn to the conveying surface 9, the sheet 70 can be easily separated from the conveying surface 9 by the separation plate 24.

The gap control unit 65 controls the gap between the discharging surface 2*a* and the conveying surface 9 by controlling the driving of the driving motor 52 of the frame moving mechanism 51 for vertically moving the frame 4 to which the inkjet heads 2 are fixed. More specifically, the gap control unit 65 controls the gap by moving the inkjet heads 2 vertically on the basis of the distance of the sheet 70 detected by the lift detection unit 63. In an initial state, the gap is set at 1.0 mm. When the distance detected by the lift detection unit 63 is within the first predetermined range, the gap is not changed. When it is detected that the distance is within the second predetermined range, the gap is increased to 1.2 mm. When it is detected that the distance is within the third predetermined range, the gap is increased to 2.0 mm.

The discharging control unit 66 controls the discharging timing of ink droplets from the nozzles (not shown) of the inkjet heads 2 and the minimum volume of the discharged ink droplets. More specifically, the discharging control unit 66 controls the inkjet heads 2 so as to discharge ink droplets from the nozzles after the upward movement of the inkjet heads 2 by the frame moving mechanism 51 is completed under the control of the gap control unit 65. Further, the discharging control unit 66 controls the minimum volume of ink droplets on the basis of the distance of the sheet 70 detected by the lift detection unit 63. That is, when the distance detected by the lift detection unit 63 is within the first predetermined range, the minimum volume of ink droplets is 2 pl. When it is detected that the distance is within the second predetermined range or the third predetermined range and the gap is increased above the initial value of 1.0 mm, the minimum volume of ink droplets is increased to 5 pl.

The conveying-speed control unit 67 controls the conveying speed of the sheet 70 conveyed by the conveyor belt 8 by controlling the driving of the driving motor 17 that rotates the belt roller 6. More specifically, the conveying-speed control unit 67 controls the conveying speed on the basis of the distance of the sheet 70 detected by the lift detection unit 63. In the initial state, the conveying speed is set at 600 mm/sec. When the distance detected by the lift detection unit 63 is within the first predetermined range or the second predetermined range, the conveying speed is not changed. When it is detected that the distance is within the third predetermined range, the conveying speed is decreased to 300 mm/sec by reducing the rotation speed of the belt roller 6.

When the distance detected by the lift detection unit 63 is within the fourth predetermined range, the recording stop unit 68 stops the control of the inkjet heads 2 by the discharging control unit 66 so that ink droplets do not land on the sheet 70.

A procedure for recording an image with the printer 1 will be described with reference to FIG. 7 as a flowchart.

First, detection is performed by the film sensor 5 (Step S1). That is, the film sensor 5 emits a light beam onto a detecting position on the conveying surface 9, and outputs a signal indicating the amount of reflected light of the light beam to the film detection unit 61. The film detection unit 61 determines whether a non-adhesive region has been detected (Step S2). More specifically, since the amount of reflected light increases when the silver film 9*a* bonded to the non-adhesive region reaches the detecting position, the determination of whether a non-adhesive region has reached the detecting position is made depending on whether the amount of reflected light has increased.

When it is determined that the non-adhesive region has not reached the detecting position (Step S2: NO), Step S1 is performed again to make detection by the film sensor 5. In contrast, when it is determined that the non-adhesive region has reached the detecting position (Step S2: YES), a sheet 70 is supplied from the sheet tray 25 under the control of the supply control unit 64 so that the leading edge of the sheet 70 in the conveying direction is placed in the non-adhesive region (Step S3). Subsequently, the leading-edge detection unit 62 starts to detect the leading edge of the sheet 70 (Step S4). In this case, the timer 69 starts to measure a leading-edge detection period of a predetermined time. Then, it is determined whether the leading edge of the sheet 70 has been detected (Step S5).

When the leading edge of the sheet 70 has not been detected (Step S5: NO), it is determined whether the leading-edge detection period has expired (Step S6). When it is determined that the leading-edge detection period has not expired (Step S6: NO), Step S5 for determination is performed again. In contrast, when it is determined that the leading-edge detection period has expired (Step S6: YES), that is, when the leading edge of the sheet 70 has not been detected during the leading-edge detection period, conveyance of the sheet 70 by the conveyor belt 8 is stopped (Step S7). This is because it can be thought in this case that the sheet tray 25 is empty, or the sheet 70 has jammed between the sheet tray 25 and the detecting position of the leading-edge sensor 3.

When the leading edge of the sheet 70 is detected in Step S5 (Step S5: YES), the distance sensor 10 starts to detect the distance (Step S8). That is, emission of light beams from the light-emitting elements 11*a*, 11*b*, and 11*c* is started. In this case, the timer 60 is temporarily reset, and starts to measure a lift detection period of a predetermined time.

Next, it is determined whether any of the light beams emitted from the three light-emitting elements 11*a*, 11*b*, and 11*c* is blocked by the sheet 70 (Step S9). When none of the light beams are blocked (Step S9: NO), Step S10 that will be described below is omitted, and Step S11 is performed. In contrast, when any one of the light beams is blocked (Step S10: YES), an output signal is transmitted to the lift detection unit 63 (Step S10)indicating the light emitting element whose light beam has been blocked. Then, it is determined whether the lift detection period has expired (Step S11).

When it is determined that the lift detection period has not expired (Step S11: NO), Step S9 for determination is performed again. In contrast, when it is determined that the lift detection period has expired, emission of the light beams from the light-emitting elements 11*a*, 11*b*, and 11*c* is stopped, and detection by the distance sensor 10 is complete (Step S12). That is, determination in Step S9 is repeated during the lift detection period. Subsequently, the lift detection unit 63 detects the level of the distance on the basis of the signal output from the distance sensor 10 during the lift detection period (Step S13). That is, when the lift detection unit 63 does not receive an output signal from the distance sensor 10, it determines that the distance is within the first predetermined range. When the lift detection unit 63 receives only an output signal indicating that the light beam from the light-emitting element 11*a* is blocked, it determines that the distance is within the second predetermined range. When the lift detection unit 63 receives an output signal indicating that the light beam from at least the light-emitting element 11*b*, is blocked and the light beam from the light-emitting element 11*c* is not blocked, it determines that the distance is within the third predetermined range. When the lift detection unit 63 receives an output signal indicating that the light beam from at least the light-emitting element 11*c*, it determines that the distance is within the fourth predetermined range.

Subsequently, adjustments are made by the gap control unit 65, the discharging control unit 66, the conveying-speed control unit 67, and the recording stop unit 68 on the basis of the determination result obtained in Step S13 (Step S14). More specifically, when it is determined in Step S13 that the distance level of the sheet 70 is within the first predetermined range, the minimum volume of ink droplets is set at 2 pl by the discharging control unit 66. When it is determined that the distance level is within the second predetermined range, the gap between the discharging surface 2*a* and the conveying surface 9 is increased from the initial value of 1.0 mm to 1.2 mm by the gap control unit 65, and the minimum volume of ink droplets is set at 5 pl. When it is determined that the distance level is within the third predetermined range, the gap is increased to 2.0 mm, the minimum volume of ink droplets is set at 5 pl, and the conveying speed of the sheet 70 is decreased from the initial value of 600 mm/sec to 300 mm/sec by the conveying-speed control unit 67. When it is determined that the distance level is within the fourth predetermined range, control of the inkjet heads 2 by the discharging control unit 66 is stopped by the recording stop unit 68 so that recording on the sheet 70 is not performed.

Finally, after adjustments in Step S14 are completed, an image is recorded on the sheet 70 by discharging ink droplets from the inkjet heads 2 under the control of the discharging control unit 66 (Step S15).

In the first embodiment, the above-described procedure may be performed for each sheet. That is, every time one sheet 70 is supplied from the sheet tray 25, the above-described procedure is performed, and the gap between the discharging surface 2*a* and the conveying surface 9, the conveying speed of the sheet 70, and/or the minimum volume of ink droplets may be adjusted in accordance with the distance of the sheet 70 at the detecting position of the distance sensor 10. However, since a plurality of sheets 70 stored in the sheet tray 25 may be similarly curled, when a job of printing on a plurality of sheets is submitted to the printer 1, the above-described procedure can be performed for the first print only, and then printing on the second and subsequent sheets can be performed without further changing the state.

Figure 8:
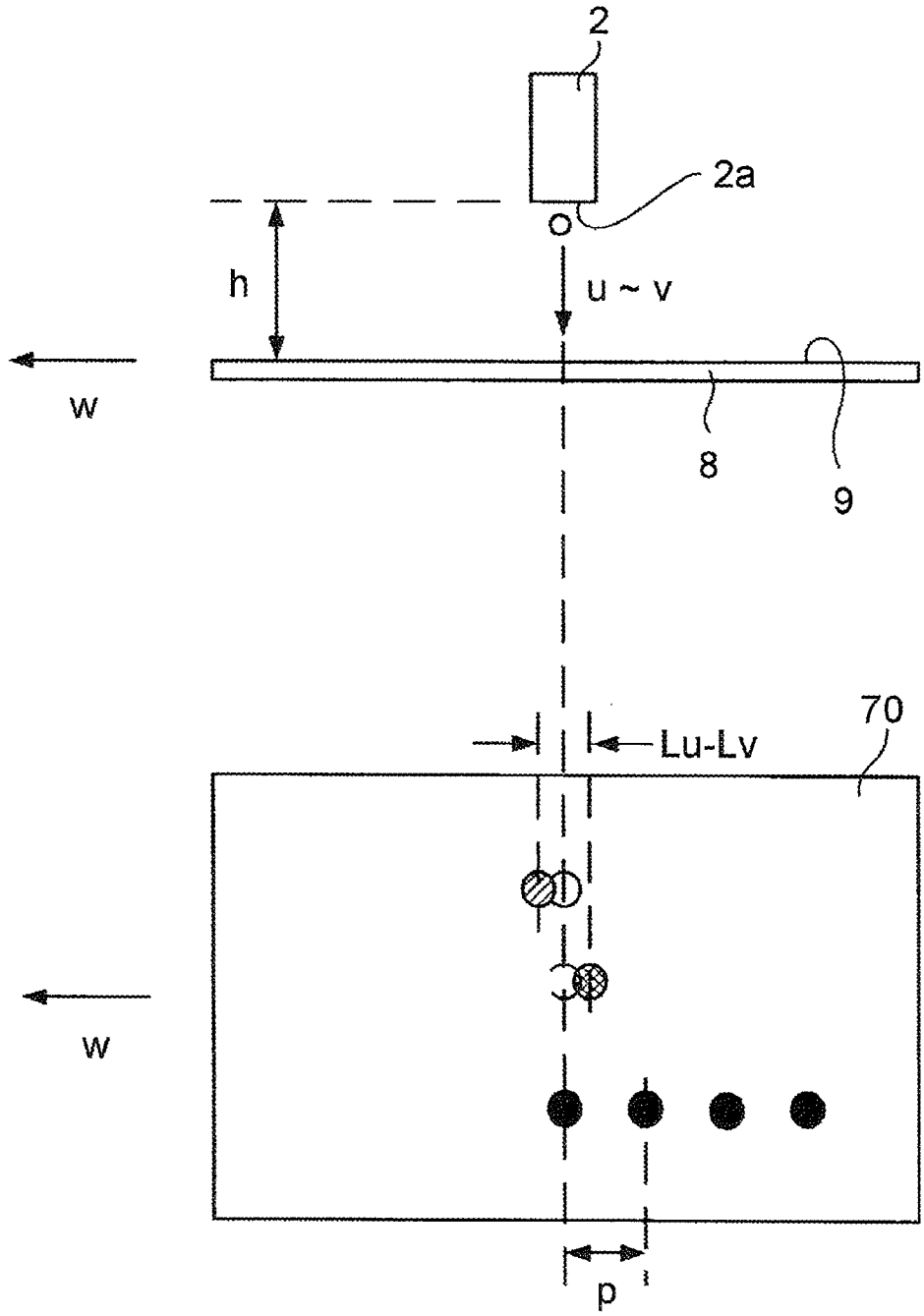
FIG. 8 is an explanatory view showing displacement of the landing position of ink droplets due to variations in velocity in the printer shown in FIG. 1.

The velocity of ink droplets discharged from the inkjet heads 2 varies slightly. In the first embodiment, the minimum velocity of ink droplets is about 9 m/sec, and the maximum velocity is about 11 m/sec. Because of these variations in velocity of ink droplets, the landing positions of the ink droplets on the sheet 70 are displaced in the conveying direction of the sheet 70. In FIG. 8, a desired landing position of an ink droplet is shown by a region enclosed by a broken line, a landing position of an ink droplet discharged at the maximum velocity is shown by a diagonally shaded region, and a landing position of an ink droplet discharged at the minimum velocity is shown by a crosshatched region. As shown in FIG. 8, an ink droplet discharged at high velocity lands on a position shifted from the desired landing position toward the leading edge (left side) in the conveying direction of the sheet 70. An ink droplet discharged at low velocity lands on a position shifted from the desired landing position toward the trailing edge (right side) in the conveying direction of the sheet 70.

Further, the difference Tu−Tv in the reaching time, which is taken for the ink droplet to reach the sheet 70, between the ink droplet with the minimum velocity and the ink droplet with the maximum velocity and the difference Lu−Lv in the landing position therebetween are given by the following Expressions 1 and 2:

$$Tu - Tv = h\left(\frac{1}{u} - \frac{1}{v}\right) \quad \text{Expression 1}$$

$$Lu - Lv = w \times (Tu - Tv) \quad \text{Expression 2}$$

where w represents the conveying speed of the sheet 70, u represents the minimum velocity of ink droplets, v represents the maximum velocity of ink droplets, and h represents the gap between the discharging surface 2*a* and the conveying surface 9.

For example, when the conveying speed w of the sheet 70 is at the initial value of 600 mm/sec and the gap h between the discharging surface 2*a* and the conveying surface 9 is at the initial value of 1.0 mm, the difference Tu−Tv in the reaching time between the ink droplet with the minimum velocity u of 9 m/sec and the ink droplet with the maximum velocity v of 11 m/sec is given as 0.00002 sec by the above Expression 1. The difference Lu−Lv in the landing position is given as 0.012 mm by the above Expression 2.

The inkjet head 2 in the first embodiment forms an image with a resolution of 600 dpi. Therefore, when the landing position of the ink droplet is not displaced, the interval p between dots arranged in line in the conveying direction of the sheet 70, as shown by black dots in FIG. 8, is 0.042 mm. That is, in the above-described case in which the difference Lu−Lv in the landing position is 0.012 mm, displacement of 28.5% is caused.

In a case in which the distance level of the sheet 70 is within the third predetermined range and the gap h between the discharging surface 2*a* and the conveying surface 9 is increased to 2.0 mm, as described above, and when the conveying speed w of the sheet 70 remains the initial value of 600 mm/sec, the difference Tu−Tv in the reaching time between the ink droplet with the minimum velocity u of 9 m/sec and the ink droplet with the maximum velocity v of 11 m/sec is given as 0.0004 sec by the above Expression 1. The difference Lu−Lv in the landing position is given as 0.024 mm by the above Expression 2. In this case, displacement of 57.1% is caused.

As described above, when the gap h between the discharging surface 2*a* and the conveying surface 9 increases, the difference Lu−Lv in the landing position increases in proportion to the gap h due to the difference in the velocity of the ink droplets. This reduces the quality of images formed by the printer 1. Expression 2 shows that the difference Lu−Lv in the landing position is also in proportion to the conveying speed w of the sheet 70. Therefore, the increase of the difference Lu−Lv in the landing position due to the increase of the gap h can be suppressed by decreasing the conveying speed w of the sheet 70.

In a case in which the gap h is increased to 2.0 mm, and when the conveying speed w of the sheet 70 is decreased from the initial value of 600 mm/sec to 300 mm/sec, the difference Tu−Tv in the reaching time to the sheet 70 between the ink droplet with the minimum velocity u of 9 m/sec and the ink droplet with the maximum velocity of 11 m/sec is given as 0.00004 sec by the above Expression 1. The difference Lu−Lv in the landing position is given as 0.012 mm by the above Expression 2. That is, displacement is 28.5% in this case, and this is the same as when the gap h and the conveying speed w are the initially set values.

As described above, in the printer 1 according to the first embodiment, an image is formed on a sheet 70 that is conveyed by the conveyor belt 8 laid between the two belt rollers 6 and 7 while facing the discharging surfaces 2*a* of the inkjet heads 2. The frame 4 to which the inkjet heads 2 are fixed can be moved by the frame moving mechanism 51 in the direction orthogonal to the discharging surfaces 2*a* of the inkjet heads 2. Further, the distance sensor 10 for detecting the distance of the leading edge of the sheet 70 from the conveying surface 9 is provided upstream from the inkjet heads 2 in the conveying direction of the sheet 70. When the distance detected by the distance sensor 10 is within the second predetermined range (e.g. more than or equal to the first distance and less than the second distance), the gap control unit 65 controls the frame moving mechanism 51 so as to increase the gap between the discharging surface 2*a* and the conveying surface 9. After the gap is increased, the discharging control unit 66 controls the inkjet heads 2 so as to discharge ink droplets.

Accordingly, when the distance of the sheet 70 is within the second predetermined range, image recording can be performed while the gap between the discharging surface 2*a* and the conveying surface 9 is increased. Therefore, the sheet 70 is prevented from touching the discharging surfaces 2*a*, and hence several advantages are achieved, such as prevention of waste of sheets, damage to the discharging surfaces 2*a*, and jamming of the sheets. This improves the operating efficiency. Especially in the first embodiment, the sheet 70 is conveyed while the leading edge is placed in the non-adhesive region on the conveying surface 9, and the leading edge easily lifts from the conveying surface 9. Therefore, advantages of the above-described structure are achieved.

In the printer 1 according to the first embodiment, the discharging control unit 66 controls the inkjet heads 2 so that the minimum volume of ink droplets discharged from the inkjet heads 2 when the distance is within the second predetermined range is more than the minimum volume of ink droplets discharged when the distance is within the first predetermined range. Therefore, when the distance is within the second predetermined range, the gap is increased by the control of the gap control unit 65, but nonetheless ink mist can be reduced. Consequently, it is possible to prevent improper operation due to ink mist and soiling of the sheet 70 with ink.

When the distance of the sheet 70 is within the third predetermined range of more than or equal to the second distance and less than the third distance, the gap control unit 65 controls the frame moving mechanism 51 so that the gap becomes more than when the distance is within the second predetermined range. Therefore, even when the sheet 70 greatly lifts from the conveying surface 9, the operating efficiency can be improved while still preventing the sheet 70 from touching the discharging surface 2*a*.

In addition, when the distance of the sheet 70 is within the third predetermined range, the conveying-speed control unit 67 reduces the speed of conveyance of the sheet 70 by the conveyor belt 8. Therefore, when the distance is within the third predetermined range, the gap is increased by the gap control unit 65 so as to be greater than when the distance is within the second predetermined range, but the amount of displacement of landing positions of the ink droplets can still be minimized. This prevents degradation of images to be formed.

When the distance of the sheet 70 is within the fourth predetermined range of more than or equal to the third distance, the recording stop unit 68 stops the control of the inkjet heads 2 by the discharging control unit 66 so that ink droplets do not land on the sheet 70. Therefore, the sheet 70 can be prevented from jamming even when it lifts from the conveying surface 9 to an extent such that the problem of lifting cannot be solved by changing the gap between the discharging surface 2*a* and the conveying surface 9.

The leading-edge sensor 3 capable of detecting whether the leading edge of the sheet 70 has reached the detecting position is provided upstream from the distance sensor 10 in the conveying direction of the sheet 70. The distance sensor 10 detects the distance of the sheet 70 during the predetermined leading-edge detection period after the leading edge of the sheet 70 is detected by the leading-edge sensor 3. Therefore, an error in detecting the distance of the sheet 70 can be prevented.

Second Embodiment

Figure 9:
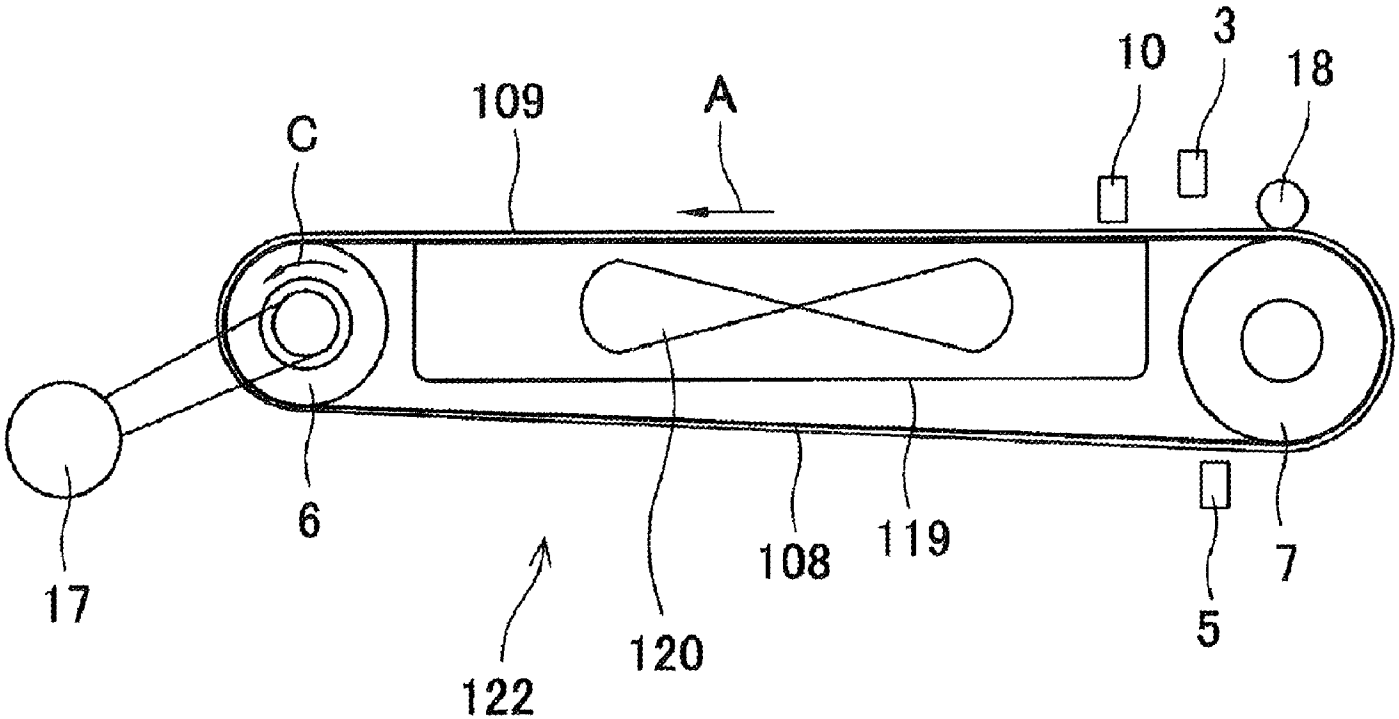
FIG. 9 is a schematic sectional side view showing a conveying mechanism and its surroundings provided in a printer according to a second embodiment described herein.
Figure 10:
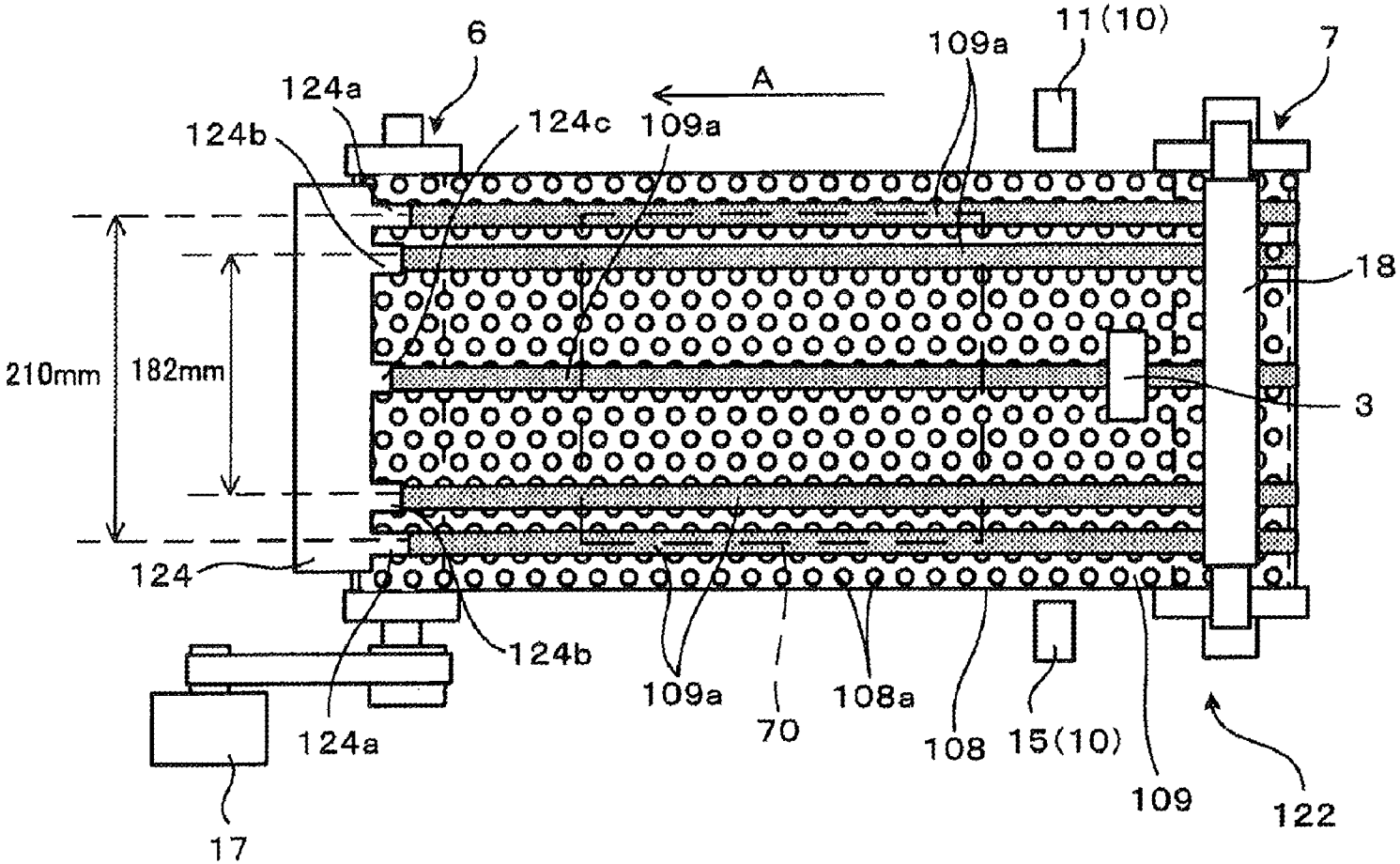
FIG. 10 is a plan view of the conveying mechanism and its surroundings shown in FIG. 9.

A second embodiment of the present disclosure will now be described with reference to FIGS. 9 and 10. FIGS. 9 and 10 are a schematic sectional side view and a plan view, respectively, of a conveying mechanism and its surroundings in a printer according to the second embodiment. The configuration of the printer in the second embodiment is substantially similar to that of the above-described printer 1 according to the first embodiment except in the structure of a conveying mechanism 122. In the following description, structures similar to those in the first embodiment are denoted by the same reference numerals, and descriptions thereof will be omitted appropriately.

In the second embodiment, as shown in FIG. 10, a conveyor belt 108 has many through holes 108*a* distributed uniformly. Upper and lower surfaces of a platen 119 that supports the conveyor belt 108 from the inner peripheral side has many holes (not shown). As shown in FIG. 9, a fan 120 for generating air flows heading from top to bottom is provided in the platen 119. Therefore, air on the conveyor belt 108 is sucked downward through the through holes 108*a*. A sheet 70 placed on a conveying surface 109 of the conveyor belt 108 is thereby drawn onto the conveying surface 109. An outer peripheral surface of the conveyor belt 108 is siliconized to be adhesive, similarly to the first embodiment. Therefore, even in a state in which the fan 120 is stopped, the sheet 70 can still be drawn to the conveying surface 109 by the adhesiveness of the conveyor belt 108.

As shown in FIG. 10, five non-adhesive films 109*a* are bonded to the conveying surface 109. The five films 109*a* are annular in the driving direction of the conveyor belt 108, and are arranged in the main scanning direction. Since the through holes 108*a* in regions of the conveying surface with the films 109*a* are closed by the films 109*a*, the regions serve as non-adhesive regions onto which a sheet 70 is not drawn by the air flow. Further since the films 109*a* are not adhesive, the sheet 70 is not drawn in the non-adhesive regions by the adhesiveness of the conveying surface 109. Regions of the conveying surface 109 without the films 109*a* serve as adhesive regions. That is, the non-adhesive regions and the adhesive regions, which may be annular such as to surround the belt rollers 6 and 7, may be alternately provided in the main scanning direction on the conveying surface 109.

The center one of the five films 109*a* is disposed in the center of the conveyor belt 108 in the main scanning direction. Two of the films 109*a* disposed at an equal distance from both sides of the center film 109*a* are arranged so that a space of 182 mm is formed therebetween. This space coincides with the width of a B5-sized sheet. The remaining two films 109*a* disposed on the outermost sides in the main scanning direction and at an equal distance from the center film 109*a* are arranged so that a space of 210 mm is formed therebetween. This space coincides with the width of an A4-sized sheet. Therefore, regardless of whether a sheet 70 is B5-sized or A4-sized, when the sheet 70 is supplied from the sheet tray 25 so that its center in the main scanning direction is made to coincide with the center of the conveyor belt 108 in the main scanning direction by positioning plates 28, both sides of the sheet 70 in the conveying direction are placed on the non-adhesive regions to which the films 109*a* are bonded.

As shown in FIG. 10, a separation plate 124 has separation claws 124*a*, 124*b*, and 124*c* protruding from the side of a sheet output tray 23 toward the conveyor belt 108 (from left to right in the figure). The separation claw 124*c* is disposed in the center of the conveyor belt 108 in the rotation axis direction of the belt roller 6. The separation claws 124*b* are disposed on either side of the separation claw 124*c*, and the separation claws 124*a* are disposed outside of the separation claws 124*b*. The separation claws 124*a*, 124*b*, and 124*c* are aligned with the corresponding films 109*a* in the conveying direction.

Similarly to the above-described first embodiment, the heights of the upper surfaces of the separation claws 124*a*, 124*b*, and 124*c* are substantially equal to the conveyance height. The separation claws 124*b*, which are provided inside the separation claws 124*a* in the main scanning direction, are tapered at the leading ends thereof, and the height of the leading ends is less than the conveyance height. Further, the separation claw 124*c* disposed inside the separation claws 124*b* in the main scanning direction is tapered more deeply at the leading end thereof than the tapered ends of the separation claws 124*b*, and the height of the tapered portion is less than the height of the separation claws 124*b*. That is, the height of the leading end of the separation claw decreases as the position of the separation claw becomes farther apart from both sides of the conveyor belt 108.

Therefore, for example, when the sheet 70 is A4-sized, it is conveyed near the belt roller 6 while being held on the conveying surface 109 in a state in which its center in the main scanning position is made to coincide with the center of the conveyor belt 108 by the positioning plates 28. Portions near both sides of the leading edge of the sheet 70 in the conveying direction then come into contact with the two separation claws 124*a* at the conveyance height, and are thereby separated from the conveying surface 109. Subsequently, the leading edge of the sheet 70 comes into contact with the two separation claws 124*b* below the conveyance height, and then comes into contact with the separation claw 124*c* below the two separation claws 124*b*. Consequently, the portion near the leading edge of the sheet 70 is separated from the conveying surface 109.

As described above, in the second embodiment, the sheet 70 is conveyed while both sides thereof in the conveying direction are placed on the non-adhesive regions of the conveying surface 109. Although the portions near both sides of the sheet 70 in the main scanning direction easily lift from the conveying surface 109, the sheet 70 is prevented from touching the discharging surface 2*a* by adjusting the gap between the discharging surface 2*a* and the conveying surface 109, similarly to the first embodiment. This improves the operating efficiency while also providing the additional advantages of avoiding waste of sheets, damage to the discharging surface 2*a*, and jamming of the sheets.

Third Embodiment

Figure 11:
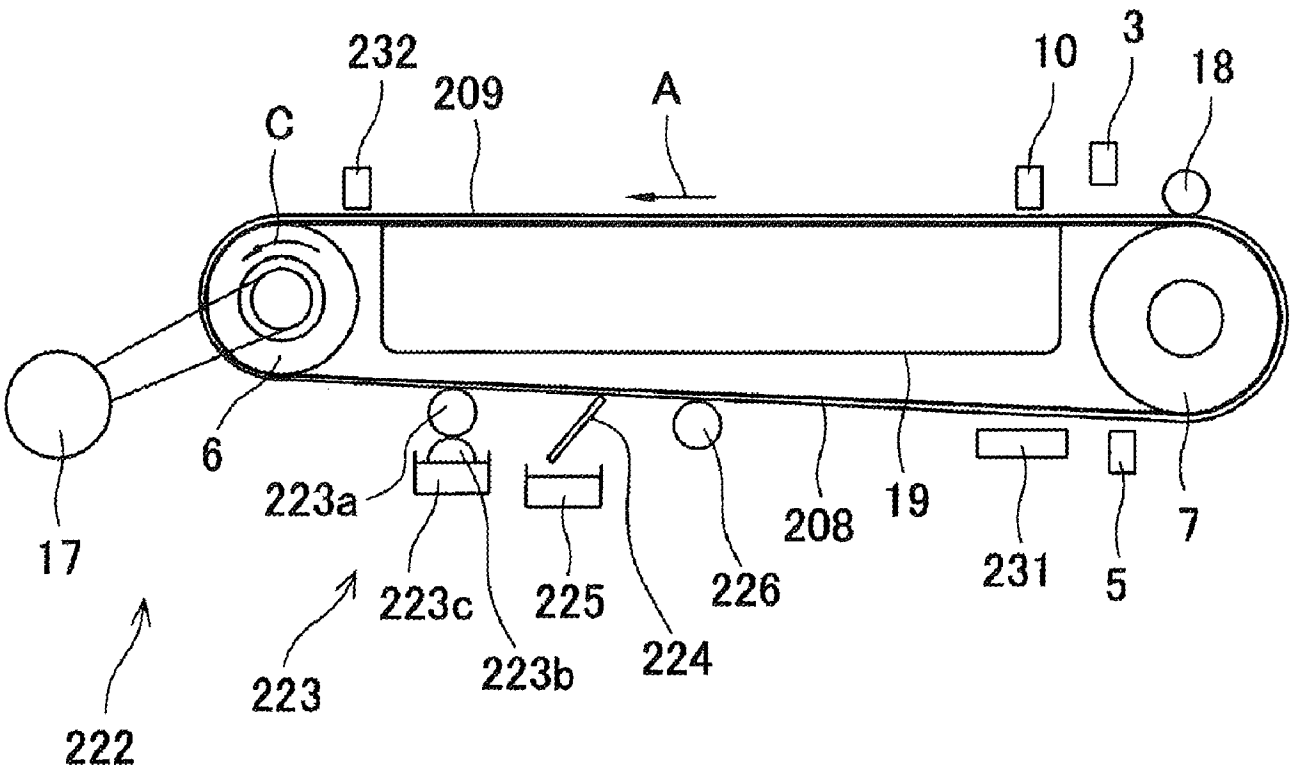
FIG. 11 is a schematic sectional side view showing a conveying mechanism and its surroundings provided in a printer according to a third embodiment described herein.
Figure 12:
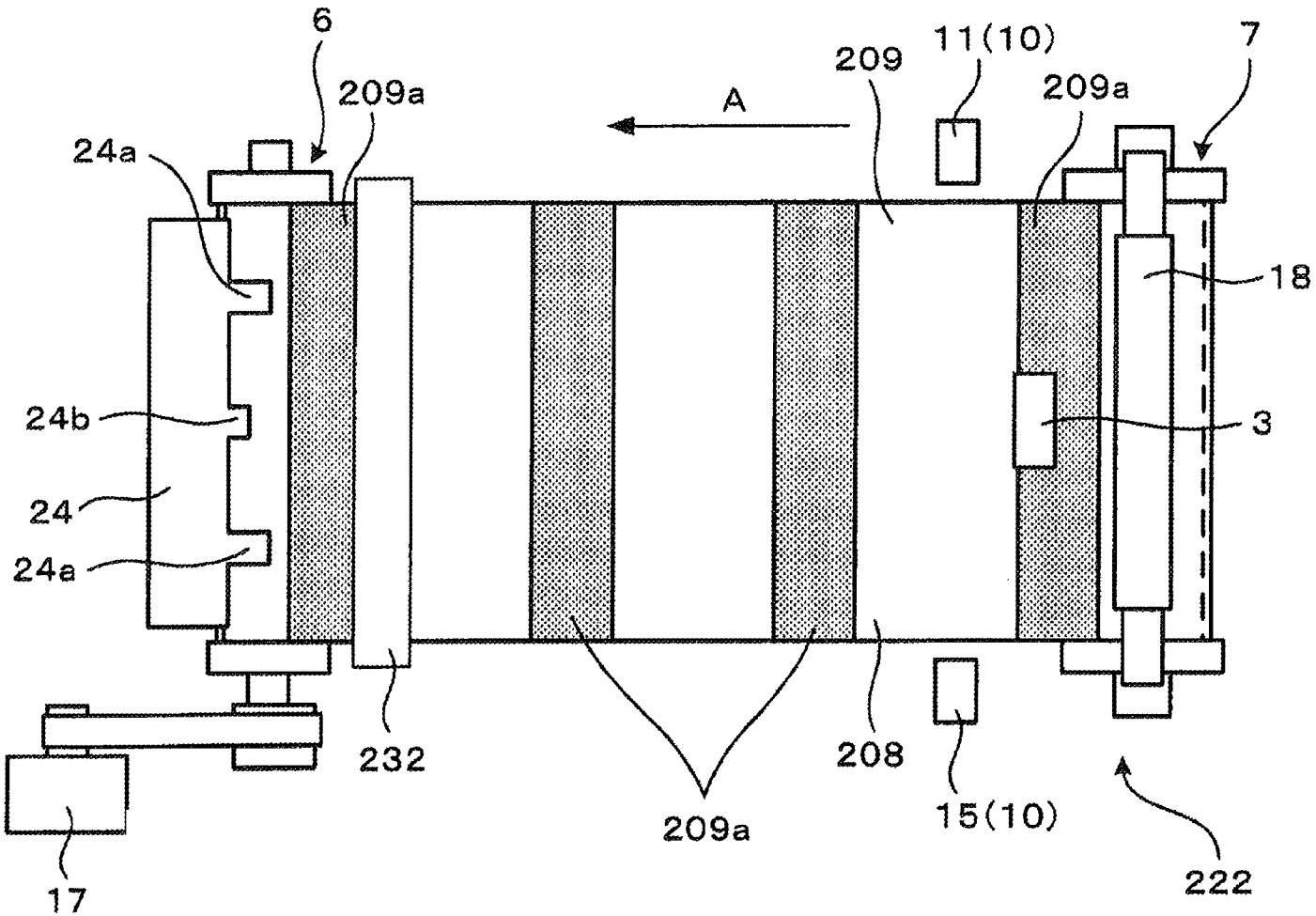
FIG. 12 is a plan view of the conveying mechanism and its surroundings shown in FIG. 11.

A third embodiment of the present disclosure will now be described with reference to FIGS. 11 and 12. FIGS. 11 and 12 are a schematic sectional side view and a plan view, respectively, of a conveying mechanism and its surroundings in a printer according to the third embodiment. While the conveyor belt 8 draws a sheet 70 by adhesiveness in the first embodiment, a conveyor belt 208 in the third embodiment attracts a sheet 70 by an electrostatic force. Other structures are substantially similar to those adopted in the first embodiment. The structures substantially similar to those in the first embodiment are denoted by the same reference numerals, and descriptions thereof will be omitted appropriately.

In the third embodiment, the conveyor belt 208 is formed of a high polymeric material having a high insulation resistance, such as polyimide, polyamide, polycarbonate, or nylon, and is highly chargeable. As shown in FIG. 11, the conveyor belt 208 is charged by a charging device 231 disposed therebelow, and is discharged by a discharging device 232 that is disposed on the conveying-direction downstream side of an inkjet head 2 disposed thereabove. A surface of the conveyor belt 208 is coated with a paint, such as urethane, so as to have a high coefficient of friction.

As shown in FIG. 12, a plurality of films 209*a* are bonded to a conveying surface 209 of the conveyor belt 208, and are arranged in the conveying direction (direction of arrow A). The films 209*a* are not adhesive and may be formed of a material that is less chargeable than the conveyor belt 208, for example, carbon. Therefore, the conveying surface 209 includes non-adhesive regions with the films 209*a* which do not attract the sheet 70, and adhesive regions without the films 209*a* that attract the sheet 70 by an electrostatic force when the conveyor belt 208 is charged by the charging device 231. The adhesive regions and the non-adhesive regions may be alternately provided in the conveying direction of the sheet 70. Since the adhesive regions have a high coefficient of friction because of, for example, a urethane coating, as described above, surface tension is produced by ink adhering to the conveying surface 209. Therefore, even when the conveyor belt 208 is not charged, the sheet 70 can still be drawn to the adhesive regions by surface tension.

Below the conveyor belt 208, a cleaning unit 223, a wiper 224, and a wiping roller 226 are arranged in that order from a belt roller 6 toward a belt roller 7 between the charging device 231 and the belt roller 6. These components perform cleaning for removing dirt and dust adhering to the adhesive regions of the conveying surface 209, including paper dust of the sheet 70, by the electrostatic force of the charged conveyor belt 208. In the third embodiment, cleaning is performed in a state in which the conveyor belt 208 is discharged by the discharging device 232.

The cleaning unit 223 includes a cleaning roller 223*a* in contact with the conveying surface 209, a supply roller 223*b* in contact with the outer peripheral surface of the cleaning roller 223*a* so as to supply cleaning solution to the cleaning roller 223*a*, and a cleaning-solution tank 223*c* that stores and supplies the cleaning solution to the supply roller 223*b*. The wiper 224 may be formed by a plate made of an elastic material such as rubber, and an end thereof may be in contact with the conveying surface 209. Further, the wiper 224 may be inclined downward in a direction opposite the driving direction of the conveyor belt 208 (a direction from the belt roller 6 toward the belt roller 7). A waste solution tank 225 may be provided below the lower end of the wiper 224. The wiping roller 226 may be hygroscopic, and may be in contact with the conveying surface 209.

With the above-described configuration, when the conveyor belt 208 is driven, the cleaning roller 223*a* and the supply roller 223*b* in contact with the conveying surface 209 are rotated. In this case, the cleaning solution stored in the cleaning-solution tank 223*c* is applied onto the conveying surface 209 via the supply roller 223*b* and the cleaning roller 223*a*. Then, the cleaning solution applied on the conveying surface 209 is scraped together with dirt and dust adhering to the conveying surface 209 by the wiper 224. The cleaning solution, including dirt and dust, scraped off by the wiper 224 flows down into the waste solution tank 225 along an upper surface of the wiper 224. Finally, the conveying surface 209 scraped by the wiper 224 is wiped by the wiping roller 226. Consequently, dirt and dust, such as paper dust of the sheet 70, adhering to the adhesive regions of the conveying surface 209 are removed.

As described above, in the third embodiment, the sheet 70 may be conveyed in a state in which the leading edge of the sheet 70 in the conveying direction is placed in the non-adhesive region on the conveying surface 209. Although the leading edge of the sheet 70 easily lifts from the conveying surface 209, the sheet 70 is prevented from touching the discharging surface 2*a* by adjusting the gap between the discharging surface 2*a* and the conveying surface 209, similarly to the first embodiment. This improves the operating efficiency while providing additional advantages of avoiding the waste of sheets, damage to the discharging surfaces 2*a*, and jamming of the sheets.

While the preferred embodiments of the present disclosure have been described above, the present disclosure is not limited to the embodiments, and various modifications are possible within the scope of the claims. For example, in the embodiments described above, the frame 4 for fixing the inkjet heads 2 can be moved vertically by the frame moving mechanism 51, and the gap between the discharging surfaces 2*a* and the conveying surface 9 (109, 209) is changed by moving the inkjet heads 2. Alternatively, the gap may be changed by vertically moving the belt rollers 6 and 7, on which the conveyor belt 8 (108, 208) are wound.

In the above described embodiments, the discharging control unit 66 controls the inkjet heads 2 so that the minimum volume of ink droplets discharged from the inkjet heads 2 when the distance is within the second predetermined range is more than the minimum volume of ink droplets discharged when the distance is within the first predetermined range. Alternatively, the minimum volume of ink droplets may remain constant.

In the above described embodiments, the gap is increased in three steps when the distance of the sheet 70 is within the first predetermined range, the second predetermined range, and the third predetermined range. The gap may remain same when the distance of the sheet 70 is within the second predetermined range and the third predetermined range. Further, the gap may be adjusted in three or more steps.

In the above described embodiments, the conveying-speed control unit 67 decreases the conveying speed of the sheet 70 conveyed by the conveyor belt 8 (108, 208) when the distance of the sheet 70 is within the third predetermined range. Alternatively, the conveying speed of the sheet 70 may remain constant.

In addition, in the above described embodiments, the recording stop unit 68 stops the control of the inkjet heads 2 by the discharging control unit 66 so that ink droplets do not land on the sheet 70 when the distance of the sheet 70 is within the fourth predetermined range. Alternatively, the recording stop unit 68 may be omitted.

In the above described embodiments, the distance sensor 10 detects the distance of the sheet 70 during a predetermined leading-edge detection period after the leading edge of the sheet 70 is detected by the leading-edge sensor 3. However, the period of detection by the distance sensor 10 is not limited to the above.

In the above described embodiments, the conveying surface 9 (109, 209) includes the non-adhesive regions to which the films 9*a* (109*a*, 209*a*) are bonded and the adhesive regions to which the films 9*a* (109*a*, 209*a*) are not bonded. Alternatively, for example, the entire conveying surface 9 (109, 209) may be adhesive without any non-adhesive region.

What is claimed is:

1. An image recording apparatus, comprising:

a recording head having one or more ink droplet discharge ports;

a conveyor configured to convey a recording medium opposite the recording head;

a distance sensor including light emitting elements placed at first, second and third distances away from the conveyor, wherein the distance sensor is configured to measure a distance between the conveyor and the recording medium; and a controller configured to adjust a distance between the conveyor and the recording head based on the measurement of the distance between the conveyor and the recording medium.

2. The image recording apparatus of claim 1, wherein said controller is configured to increase the distance between the conveyor and the recording head by a first value when the distance between the conveyor and the recording medium is greater than or equal to the first distance and less than the second distance.

3. The image recording apparatus of claim 2, wherein said controller is configured to increase the distance between the conveyor and the recording head by a second value when the distance between the conveyor and the recording medium is greater than or equal to the second distance and less than the third distance, said second value being greater than said first value.

4. The image recording apparatus of claim 3, wherein said controller is configured to prevent discharge of ink droplets from said recording head discharge ports when the distance between the conveyor and the recording medium is greater than or equal to the third distance.

5. An image recording apparatus, comprising:

a recording head having one or more ink droplet discharge ports;

a conveyor configured to convey a recording medium opposite the recording head; and a controller configured to adjust a distance between the conveyor and the recording head based on a measurement of a distance between the conveyor and the recording medium, wherein the controller is further configured to adjust a drop size of ink droplets discharged from said recording head based on the measurement of the distance between the conveyor and the recording medium.

6. An image recording apparatus, comprising:

a recording head having one or more ink droplet discharge ports;

a conveyor configured to convey a recording medium opposite the recording head; and a controller configured to adjust a distance between the conveyor and the recording head based on a measurement of a distance between the conveyor and the recording medium, wherein the controller is further configured to adjust a speed of the conveyor based on the measurement of the distance between the conveyor and the recording medium.

7. The image recording apparatus according to claim 1, further comprising:

a leading-edge sensor configured to detect whether a leading edge of the recording medium reaches a predetermined position on the conveyor upstream from the distance sensor, wherein the distance sensor detects the distance of the recording medium from the conveying surface during a predetermined time after the leading edge of the recording medium is detected by the leading-edge sensor.

8. The image recording apparatus of claim 1, wherein:

the conveyor is configured to convey the recording medium opposite the recording head, said conveyor including a plurality of through holes; and a fan positioned to draw air through the through holes from a top surface of the conveyor belt to an underside of the conveyor.

9. The image recording apparatus of claim 8, wherein the controller is further configured to adjust a drop size of ink droplets discharged from said recording head based on the measurement of the distance between the conveyor and the recording medium.

10. The image recording apparatus of claim 8, wherein the controller is further configured to adjust a speed of the conveyor based on the measurement of the distance between the conveyor and the recording medium.

11. The image recording apparatus of claim 8, further comprising a distance sensor having light emitting elements placed at first, second and third distances away from said conveyor, wherein said controller is configured to increase the distance between the conveyor and the recording head by a first value when the distance between the conveyor and the recording medium is greater than or equal to the first distance and less than the second distance.

12. The image recording apparatus of claim 11, wherein said controller is configured to increase the distance between the conveyor and the recording head by a second value when the distance between the conveyor and the recording medium is greater than or equal to the second distance and less than the third distance, said second value being greater than said first value.

13. The image recording apparatus of claim 1, further comprising a charging device configured to provide an electric charge to a surface of the conveyor.

14. The image recording apparatus of claim 13, wherein the controller is further configured to adjust a drop size of ink droplets discharged from said recording head based on the measurement of the distance between the conveyor and the recording medium.

15. The image recording apparatus of claim 13, wherein the controller is further configured to adjust a speed of the conveyor belt based on the measurement of the distance between the conveyor and the recording medium.

16. The image recording apparatus of claim 13, further comprising a distance sensor having light emitting elements placed at first, second and third distances away from said conveyor, wherein said controller is configured to increase the distance between the conveyor and the recording head by a first value when the distance between the conveyor and the recording medium is greater than or equal to the first distance and less than the second distance.

17. The image recording apparatus of claim 16, wherein said controller is configured to increase the distance between the conveyor and the recording head by a second value when the distance between the conveyor and the recording medium is greater than or equal to the second distance and less than the third distance, said second value being greater than said first value.

18. An image recording apparatus comprising:

a recording head having a discharging surface on which discharging ports for discharging droplets are provided;

first and second rollers having rotation shafts parallel to each other;

an endless conveyor belt laid between the first and second rollers and configured to convey a recording medium in a conveying direction from the first roller to the second roller while supporting the recording medium on a conveying surface serving as an outer peripheral surface facing the discharging surface;

a shift mechanism configured to shift the recording head or the first and second rollers in a direction orthogonal to the discharging surface so as to change a gap between the discharging surface and the conveying surface;

a distance sensor configured to detect a distance of a leading edge of the recording medium from the conveying surface when the leading edge of the recording medium is placed at a first predetermined position on the conveying surface and upstream from the recording head in the conveying direction;

a gap control unit configured to control the shift mechanism so that the gap becomes larger when the distance detected by the distance sensor greater than or equal to a first distance;

a discharging control unit configured to control the recording head to discharge the droplets from the discharging ports after the gap is increased by the shift mechanism under the control of the gap control unit, and to adjust an ink drop size of the droplets when the distance detected by the distance sensor is greater than or equal to the first distance; and a conveying-speed control unit configured to decrease a conveying speed of the recording medium conveyed by the conveying belt when the distance detected by the distance sensor is greater than or equal to the second distance.

19. The image recording apparatus of claim 1, wherein the first, second and third distances at which the light emitting elements are placed are vertical distances with respect to the conveyor.

* * * * *